United States Patent [19]

Seynhaeve

[11] Patent Number: 4,544,050

[45] Date of Patent: Oct. 1, 1985

[54] HANDLE FOR WHEELED SUITCASE

[75] Inventor: Andrë G. Seynhaeve, Senlis, France

[73] Assignee: Societe Delsey, France

[21] Appl. No.: 472,258

[22] Filed: Mar. 4, 1983

[30] Foreign Application Priority Data

Mar. 12, 1982 [FR] France ..... 82 04202

[51] Int. Cl.[4] ..... A45C 5/04; A45C 13/22

[52] U.S. Cl. ..... 190/115; 190/18 A; 190/39; 16/126

[58] Field of Search ..... 190/18 A, 39, 115; 16/115, 126, 110 R, 125; 280/39

[56] References Cited

U.S. PATENT DOCUMENTS

| | | | |
|---|---|---|---|
| 381,646 | 4/1888 | Rivers | 190/39 |
| 591,547 | 10/1897 | O'Neill | 190/39 X |
| 966,974 | 8/1910 | Williams | 16/115 X |
| 2,254,506 | 9/1941 | Wheary, Jr. | 190/115 X |
| 3,158,284 | 11/1964 | Henchert et al. | 16/126 X |
| 3,562,849 | 2/1971 | Brayshaw | 16/126 |
| 3,804,290 | 4/1974 | Billman | 16/126 X |
| 3,963,104 | 6/1976 | Lautin | 190/115 X |
| 4,261,077 | 4/1981 | Brock et al. | 190/39 X |
| 4,311,222 | 1/1982 | Castanier | 190/18 A |

FOREIGN PATENT DOCUMENTS

| | | | |
|---|---|---|---|
| 266605 | 7/1964 | Australia | 190/115 |
| 644203 | 6/1964 | Belgium | 190/18 A |
| 891564 | 4/1982 | Belgium . | |
| 2056657 | 5/1972 | Fed. Rep. of Germany | 190/18 A |
| 1145985 | 5/1957 | France | 190/18 A |
| 346124 | 6/1960 | Switzerland | 190/115 |
| 2111465 | 7/1983 | United Kingdom | 190/115 |

*Primary Examiner*—William Price
*Assistant Examiner*—Sue A. Weaver
*Attorney, Agent, or Firm*—Roylance, Abrams, Berdo & Goodman

[57] ABSTRACT

The suitcase comprises two shells (1,2) each having a large face, a lower face, and upper face and two transverse faces, two wheels (5) projecting at the lower end of traverse faces (6) of the shells, and a pulling handle (10) provided on shell (1), in the vicinity of the upper end of its other traverse face (11). Pulling handle (10) comprises an elongate support (12) fixed parallel to the axis of the wheel (5) of shell (1) and a gripping loop (13) hinged to support (12).

15 Claims, 4 Drawing Figures

HANDLE FOR WHEELED SUITCASE

The present invention relates to a suitcase comprising two shells each having one large face, one lower face, one upper face and two transverse faces, two wheels projecting at the lower end of one of the transverse faces of the shells, and a pulling handle provided on one of the two shells, in the vicinity of the upper end of its other transverse face.

The pulling handle for current wheeled cases is generally in the form of a rectilinear or slightly bent rod extending perpendicularly to the axis of the wheel of the shell which carries it.

Such pulling handles do not however give entire satisfaction for they do not offer the user a sufficient grip for him to stop with certainty the suitcase from overturning accidentally when he leaves the roadway to get on to the sidewalk or conversely, when he goes over a step, when one of the wheels of the case meets an obstacle, etc . . . .

The present invention proposes remedying this drawback and, for this, it provides a wheeled suitcase which is characterized in that its pulling handle comprises an elongate support fixed parallel to the axis of the wheel of the shell which carries it, and a gripping loop hinged to the support.

When the user takes hold of the gripping loop of the pulling handle, his hand extends parallel to the axis of the wheels of the suitcase and not perpendicularly as was the case up to now. The user thus has a better grip and may then with much greater certainty prevent the suitcase from accidentally overturning.

Preferably, the gripping loop comprises a section having two external lugs each provided with at least one swivel pin bearing on the support and extending coaxially therewith.

The hingeing of the gripping loop to the support is thus achieved simply but reliably.

Advantageously, the external lugs extend into notches formed in the support and are each provided with at least one lateral recess receiving a swivel pin, each recess comprising two opposite walls flush with the face of the support which is applied against the shell, a substantially semicylindrical bottom connecting the two walls and having a radius slightly greater than that of the corresponding swivel pin, and two opposite bosses projecting from the walls to hold the swivel pin against the bottom. It should be noted here that the support and the gripping loop may be readily connected together since it is sufficient to forcibly push the swivel pins into the recesses so that they pass between the bosses thereof.

According to a particularly robust embodiment, the external lugs each carry two coaxial swivel pins. Furthermore, to allow the pulling handle to come back automatically into an inoperative position, one at least of the swivel pins advantageously comprises an axial extension presenting a diametrical slit, this extension being housed in a cavity of the support and surrounded by a helical spring one of whose ends is held in the diametrical slit and whose other end bears against the wall of the cavity.

Preferably, the support and the loop are housed in a depression opening laterally into the large face of the shell. Since they do not project from the shell which carries them, the support and the loop are thus protected against accidental damage which may occur during air transport or similar. Moreover, since the support and the loop extend as far as the large face of the corresponding shell, the user may walk without being hindered by the suitcase which he is pulling, this latter being offset laterally because of the staggered position of its pulling handle.

One embodiment of the present invention will be described hereafter by way of example, which is in no wise limiting, with reference to the accompanying drawings in which.

Figure 1:
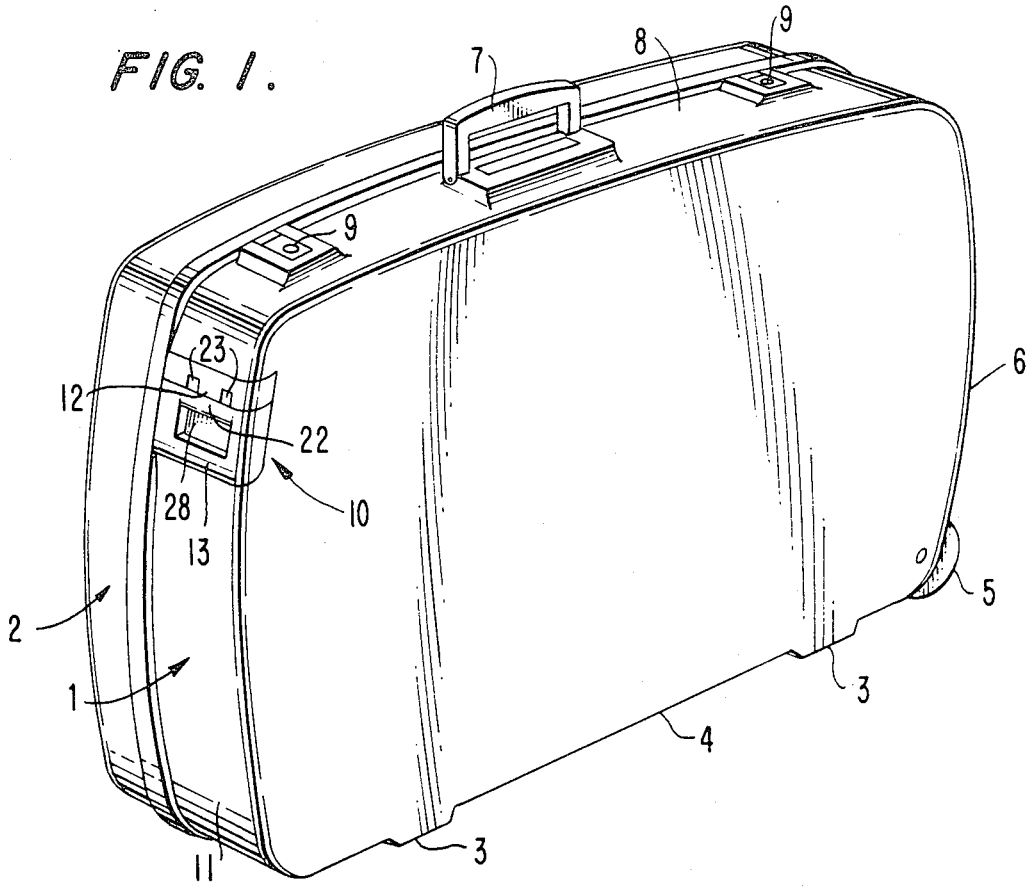
FIG. 1 is a schematical perspective view of a wheeled suitcase in accordance with the invention.

The suitcase which is shown in FIG. 1 comprises two shells 1,2 each comprising a large face, a lower face, an upper face and two transverse faces. These two shells, which are preferably made from a plastic material, form the first one the bottom and the second one the lid of the suitcase.

In the example shown, shell 1 is deeper than shell 2. It is however evident that the two shells could be identical.

In a quite conventional way, the suitcase also comprises four feet 3 of which only those provided on the lower face 4 of shell 1 are visible, two wheels 5 of which only the one projecting at the lower end of the transverse face 6 of shell 1 is visible, a carrying handle 7 provided in the center of the upper face 8 of shell 1, two locks 9 situated on each side of the carrying handle and a pulling handle 10 situated in the vicinity of the upper end of the other transverse face 11 of shell 1.

In accordance with the invention, the pulling handle 10 comprises an elongate support 12, for example rectilinear, fixed parallel to the axis of the wheel of shell 1, and a gripping loop 13 hinged to support 12.

Figure 4:
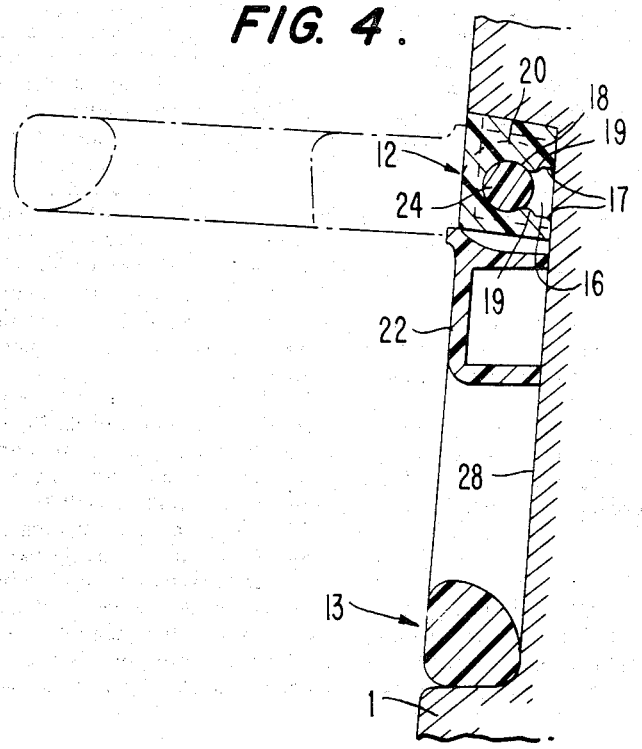
FIG. 4 is a sectional view along line IV-IV of FIG. 3, the dash-dot line showing the gripping loop when it is in its operative position.

Support 12 comprises two parallel notches 14 whose entrance opens into its upper face, i.e. the one which is turned towards the lower face of shell 1 (see FIG. 1), and whose bottom is situated at a certain distance from its upper face. Each of the notches comprises two parallel faces 15 extending perpendicularly to the longitudinal axis of support 12 and each having a lateral recess 16. As can be seen in FIG. 4, each recess 16 comprises two opposite walls 17 one of whose ends is coplanar with the face of support 12 which is applied against shell 1, a substantially semi-cylindrical bottom 18 connecting the two walls 17 together and two bosses 19 projecting therefrom at the junction thereof with the bottom 18.

In the example shown, the lateral recesses 16 are formed in transverse walls 20 connecting together the upper and lower walls of support 12 and cause notches 14 to communicate with cavities 21 whose entrances are closed by the wall of shell 1.

The gripping loop 13 comprises a section 22, for example rectilinear, having two external lugs 23 each provided laterally with two swivel pins 24. Lugs 23 are received inside notches 14 of support 12 whereas their swivel pins are held against the cylindrical bottom 18 of the lateral recesses by bosses 19 (see FIG. 4). It will be readily understood that the connection between support 12 and loop 13 may be achieved in a simple way since it is sufficient to force swivel pins 24 into recesses 16 and since the bottom and the bosses thereof form bushes for the swivel pins, which allows the gripping loop to be readily mounted pivotably on the support.

Figure 2:
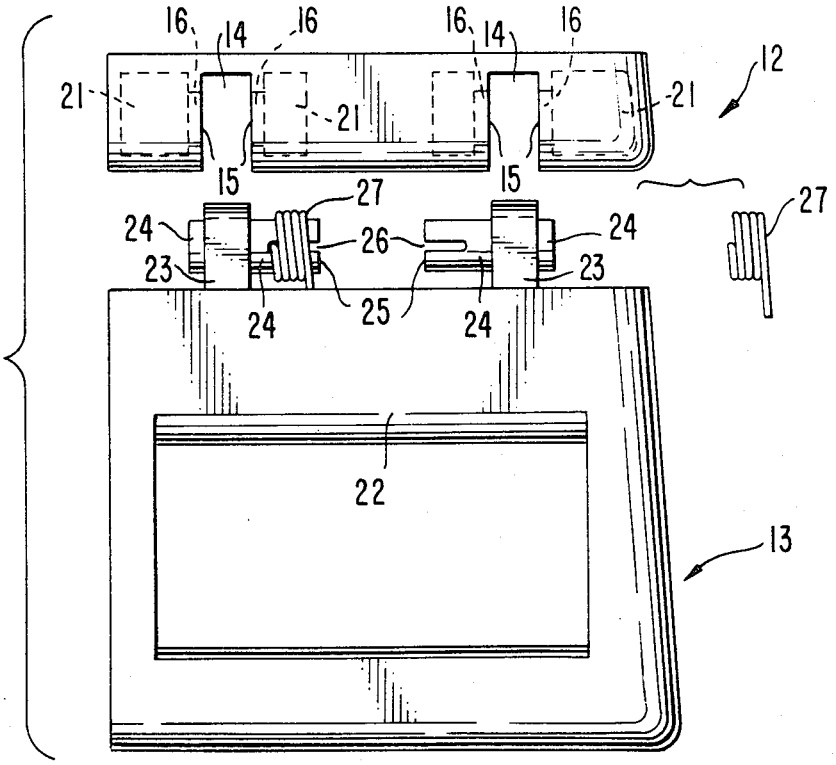
FIG. 2 is an exploded front view of the pulling handle mounted on the suitcase shown in FIG. 1.
Figure 3:
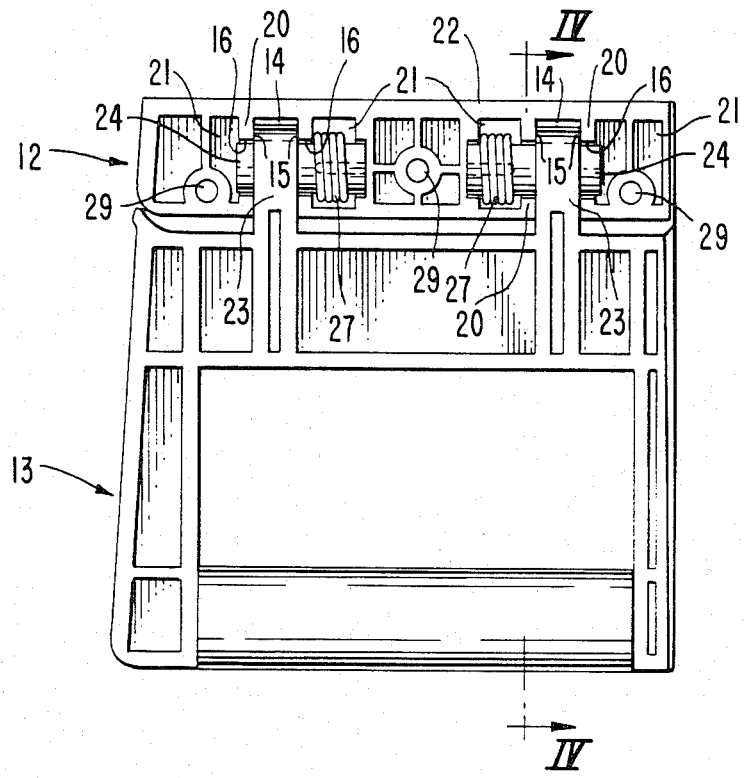
FIG. 3 is a rear view of the pulling handle, this latter being shown with its support and its gripping loop connected together.

As can be seen in FIG. 2, the two swivel pins 24 which face each other each comprise an axial extension 25 having a diametrical slit 26. As shown moreover in FIG. 3, each extension 25 is housed in one of the cavities 21 of support 12 and is surrounded by a return spring 27. One of the ends of spring 27 is held in the slit 26 of the corresponding extension 25 whereas the other end thereof bears against a wall of the corresponding cavity 21. Thus, when the gripping loop 13 is pivoted with respect to support 12, while raising it to bring it into its position shown with a dash-dot line in FIG. 4, springs 27 tighten and may consequently bring it automatically back to its initial rest position shown in FIG. 1 when it is no longer held in the hand.

Referring in particular to FIGS. 1 and 4, it will be noted that support 12 and gripping loop 13 are housed in a depression 28 formed in the transverse face 11 of shell 1 and opening laterally into the large face thereof.

The transverse ends of support 12 and of loop 13 which are situated on the same side as the large face of shell 1 have the same external profile as the junction line between this large face and the transverse face 11, whereby the shell retains its even and pleasant appearance at the level of the pulling handle.

For the sake of completeness, it should be stated that support 12 may be readily secured in depression 28. Securing thereof is in fact achieved by means of screws or any other similar means whose head bears against the internal face of the shell and whose shank, after passing therethrough, is held in bores such as those shown at 29 in FIG. 3.

To reduce manufacturing costs, it will finally be noted that support 12 and gripping loop 13 are preferably formed by molding a plastic material.

What is claimed is:

1. A suitcase, comprising:

first and second shells, each of said shells having a large face, a lower face, an upper face and first and second opposite transverse faces;

at least one wheel projecting at a lower end of one of said first transverse faces and rotatable about a wheel axis; and a pulling handle on one of said shells adjacent an upper end of one of said second transverse faces, said handle including a single, one-piece, elongated support member fixed to one of said shells parallel to said wheel axis, and a gripping member having sections forming a closed loop, one of said sections being hinged to said support member and having first and second external lugs extending perpendicular to said wheel axis, each of said lugs having at least one swivel pin pivotally engaging said support member and extending coaxially relative to said support member.

2. A suitcase according to claim 1 wherein said support member comprises first and second notches receiving said first and second lugs, respectively, each of said notches having a lateral recess receiving one of said swivel pins; each said recess includes two opposite walls extending inwardly from a support face applied against said one of said shells, a substantially semi-cylindrical bottom connecting said opposite walls and having a radius slightly larger than the respective swivel pin, and two opposing bosses projecting from said opposite walls and retaining each of said swivel pins in the respective semi-cylindrical bottom.

3. A suitcase according to claim 2 wherein each of said lugs have two coaxially extending swivel pins.

4. The suitcase according to claim 3 wherein at least one of said swivel pins comprises an axial extension with a diametrically extending slit, and a helical spring surrounding said axial extension and having opposite ends with one end of said spring held in said slit; and said support member comprises a cavity housing said axial extension and having a wall engaging the other end of said spring.

5. The suitcase according to claim 4 wherein said one of said shells comprises a depression opening laterally on said second transverse face thereof and housing said support member and said gripping member.

6. A suitcase according to claim 1 wherein each of said lugs have two coaxially extending swivel pins.

7. A suitcase according to claim 1 wherein at least one of said swivel pins comprises an axial extension with a diametrically extending slit, and a helical spring surrounding said axial extension and having opposite ends with one end of said spring held in said slit; and said support member comprises a cavity housing said axial extension and having a wall engaging the other end of said spring.

8. A suitcase according to claim 1 wherein said one of said shells comprises a depression opening laterally on said second transverse face thereof and housing said support member and said gripping member.

9. A suitcase according to claim 2 wherein said one of said shells comprises a depression opening laterally on said second transverse face thereof and housing said support member and said gripping member.

10. A suitcase according to claim 3 wherein said one of said shells comprises a depression opening laterally on said second transverse face thereof and housing said support member and said gripping member.

11. A suitcase according to claim 6 wherein said one of said shells comprises a depression opening laterally on said second transverse face thereof and housing said support member and said gripping member.

12. A suitcase according to claim 7 wherein said one of said shells comprises a depression opening laterally on said second transverse face thereof and housing said support member and said gripping member.

13. A suitcase, comprising:

first and second shells, each of said shells having a large face, a lower face, an upper face, and first and second opposite transverse faces;

at least one wheel projecting at a lower end of one of said first transverse faces and rotatable about a wheel axis; and a pulling handle on one of said shells adjacent an upper end of one of said second transverse faces, said handle including a gripping member having one section with first and second externally extending lugs, each of said lugs having at least one swivel pin, and an elongated support member fixed to one of said shells parallel to said wheel axis and coaxially relative to said swivel pins, said support having first and second notches receiving said first and second lugs, respectively, each of said notches having a lateral recess pivotally receiving one of said swivel pins, each said recess including two opposite walls extending inwardly from a support face applied against said one of said shells, a substantially semi-cylindrical bottom connecting said opposite walls and having a radius slightly larger than the respective swivel pin, and two opposing bosses projecting from said opposite walls and retaining each of said swivel pins in the respective semi-cylindrical bottom.

14. A suitcase according to claim 13 wherein each of said lugs have two coaxially extending swivel pins.

15. A suitcase according to claim 13 wherein at least one of said swivel pins comprises an axial extension with a diametrically extending slit, and a helical spring surrounding said axial extension and having opposite ends with one end of said spring held in said slit; and said support member comprises a cavity housing said axial extension and having a wall engaging the other end of said spring.

* * * * *